US007616736B2

(12) United States Patent
Warburton

(10) Patent No.: US 7,616,736 B2
(45) Date of Patent: Nov. 10, 2009

(54) LIQUID COOLED WINDOW ASSEMBLY IN AN X-RAY TUBE

(75) Inventor: Don Lee Warburton, West Jordan, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 11/864,603

(22) Filed: Sep. 28, 2007

(65) Prior Publication Data

US 2009/0086922 A1 Apr. 2, 2009

(51) Int. Cl.
*H01J 5/18* (2006.01)

(52) U.S. Cl. ..... 378/140; 378/141

(58) Field of Classification Search ..... 378/140, 378/141, 161

See application file for complete search history.

(56) References Cited

U.S. PATENT DOCUMENTS 4,731,804 A * 3/1988 Jenkins ..... 378/140
5,511,104 A 4/1996 Mueller et al.
6,005,918 A 12/1999 Harris et al.
6,215,852 B1 4/2001 Rogers et al.
6,263,046 B1 7/2001 Rogers
6,438,208 B1 8/2002 Koller
6,457,859 B1 10/2002 Lu et al.
6,529,579 B1 3/2003 Richardson
6,594,341 B1 7/2003 Lu et al.
6,714,626 B1 3/2004 Subraya et al.
7,042,981 B2 5/2006 Subraya et al.
7,260,181 B2 8/2007 McDonald et al.

* cited by examiner

*Primary Examiner*—Jurie Yun
(74) *Attorney, Agent, or Firm*—Workman Nydegger

(57) ABSTRACT

Liquid cooled window assembly for an x-ray tube. In one example embodiment, an x-ray tube window assembly includes an x-ray tube window frame that defines an opening and an x-ray tube window configured to be attached to the x-ray tube window frame. When the x-ray tube window is attached to the x-ray tube window frame, the x-ray tube window substantially covers the opening defined by the x-ray tube window frame, and the x-ray tube window cooperates with the x-ray tube window frame to define a fluid passageway disposed about at least a portion of the opening. The fluid passageway includes an inlet and an outlet.

30 Claims, 7 Drawing Sheets

LIQUID COOLED WINDOW ASSEMBLY IN AN X-RAY TUBE

BACKGROUND

X-ray tubes typically utilize an x-ray transmissive window formed in the vacuum enclosure of the x-ray tube that permits x-rays produced within the x-ray tube to be emitted from the housing and into an intended target. The window is typically set within a mounting structure, and is located in a side or in an end of the x-ray tube. The window separates the vacuum of the vacuum enclosure of the x-ray tube from the normal atmospheric pressure found outside the x-ray tube.

Although window thicknesses vary depending on the particular x-ray tube application, windows are typically very thin, often measuring 0.010 inches or less. In particular, a window with a reduced thickness is generally desired so as to minimize the amount of x-rays that are absorbed by the window material during x-ray tube operation.

While a thinner window is desirable, a thin window is typically subjected to deforming stresses during the operation of the x-ray tube. One of the major challenges in developing x-ray tubes for modern, high performance x-ray systems is to provide design features to accommodate the high levels of heat produced. To produce x-rays, relatively large amounts of electrical energy must be transferred to an x-ray tube. Only a small fraction of the electrical energy transferred to the x-ray tube is converted into x-rays, as the majority of the electrical energy is converted to heat. If excessive heat is produced in the x-ray tube, the temperature can rise above critical values, and the window of the x-ray tube can be subject to thermally-induced deforming stresses. Such thermally-induced deforming stresses are non-uniformly distributed over the surface of the window and can produce cracking in the window, as well as leaks between the window and the mounting structure.

One portion of the window which is frequently deformed during x-ray tube operation due to relatively high heat is the portion of the window that is bonded to the mounting structure. The deformation of the window can result in cracking of the window and consequent loss of vacuum from the x-ray tube housing, and thereby limit the operational life of the x-ray tube.

BRIEF SUMMARY OF EXAMPLE EMBODIMENTS

In general, example embodiments of the invention relate to a liquid cooled window assembly for an x-ray tube.

In one example embodiment, an x-ray tube window assembly includes an x-ray tube window frame that defines an opening and an x-ray tube window configured to be attached to the x-ray tube window frame. When the x-ray tube window is attached to the x-ray tube window frame, the x-ray tube window substantially covers the opening defined by the x-ray tube window frame, and the x-ray tube window cooperates with the x-ray tube window frame to define a fluid passageway disposed about at least a portion of the opening. The fluid passageway includes an inlet and an outlet.

In another example embodiment, an x-ray tube apparatus includes an x-ray tube window frame, an x-ray tube window, and an x-ray tube housing. The x-ray tube window frame defines an opening. The x-ray tube window is attached to the x-ray tube window frame such that the x-ray tube window substantially covers the opening defined by the x-ray tube window frame. The x-ray tube window frame is attached to the x-ray tube housing. The x-ray tube housing cooperates with the x-ray tube window frame to define a fluid passageway disposed about at least a portion of the opening. The fluid passageway includes an inlet and an outlet through which fluid can flow between the fluid passageway and the x-ray tube housing.

In yet another example embodiment, an x-ray tube includes a vacuum enclosure, an anode at least partially positioned within the vacuum enclosure, and a cathode at least partially positioned within the vacuum enclosure. The vacuum enclosure includes an x-ray tube housing. The x-ray tube housing defines a first inlet and a first outlet. The x-ray tube also includes an x-ray tube window assembly. The x-ray tube window assembly includes an x-ray tube window frame that defines an opening and an x-ray tube window. The x-ray tube window frame is attached to the x-ray tube housing. The x-ray tube window is attached to the x-ray tube window frame such that the x-ray tube window substantially covers the opening defined by the x-ray tube window frame. The x-ray tube housing also cooperates with the x-ray tube window frame to define a fluid passageway disposed about at least a portion of the opening. The fluid passageway includes a second inlet positioned proximate the first inlet and a second outlet positioned proximate the first outlet. Fluid can flow between the first inlet and the first outlet through the fluid passageway.

These and other aspects of example embodiments of the invention will become more fully apparent from the following description and appended claims.

BRIEF DESCRIPTION OF THE DRAWINGS

To further clarify the above and other aspects of example embodiments of the present invention, a more particular description of these examples will be rendered by reference to specific embodiments thereof which are disclosed in the appended drawings. It is appreciated that these drawings depict only example embodiments of the invention and are therefore not to be considered limiting of its scope. It is also appreciated that the drawings are diagrammatic and schematic representations of example embodiments of the invention, and are not limiting of the present invention nor are they necessarily drawn to scale. Example embodiments of the invention will be disclosed and explained with additional specificity and detail through the use of the accompanying drawings in which.

DETAILED DESCRIPTION OF EXAMPLE EMBODIMENTS

In general, example embodiments of the invention are directed to a liquid cooled window assembly for an x-ray tube. The example window assemblies disclosed herein can be employed to dissipate heat generated during x-ray tube operation and thus reduce thermally-induced deforming stresses on the window assemblies and on the x-ray tubes to which the window assemblies are attached.

I. Example X-Ray Tube

Figure 1A:
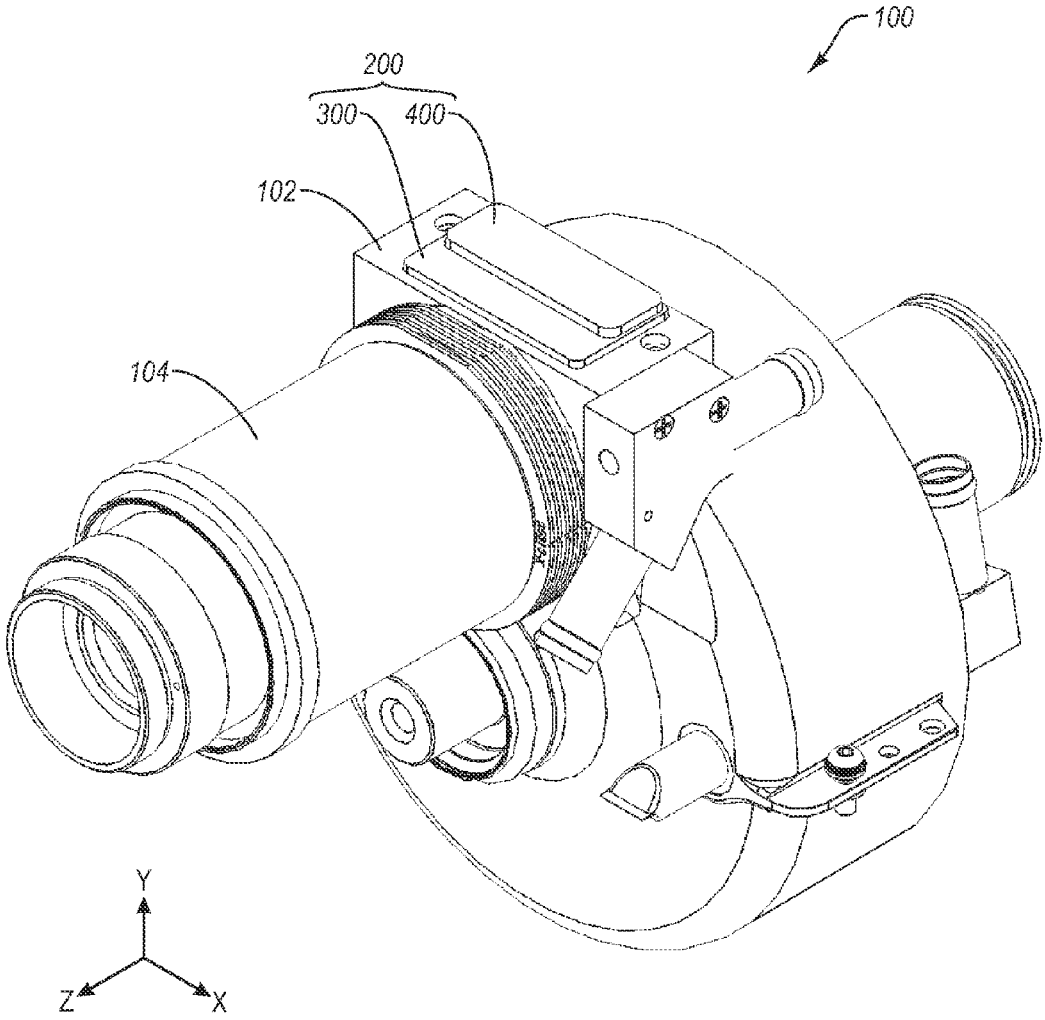
FIG. 1A is a perspective view of an example x-ray tube having an example window assembly.
Figure 1B:
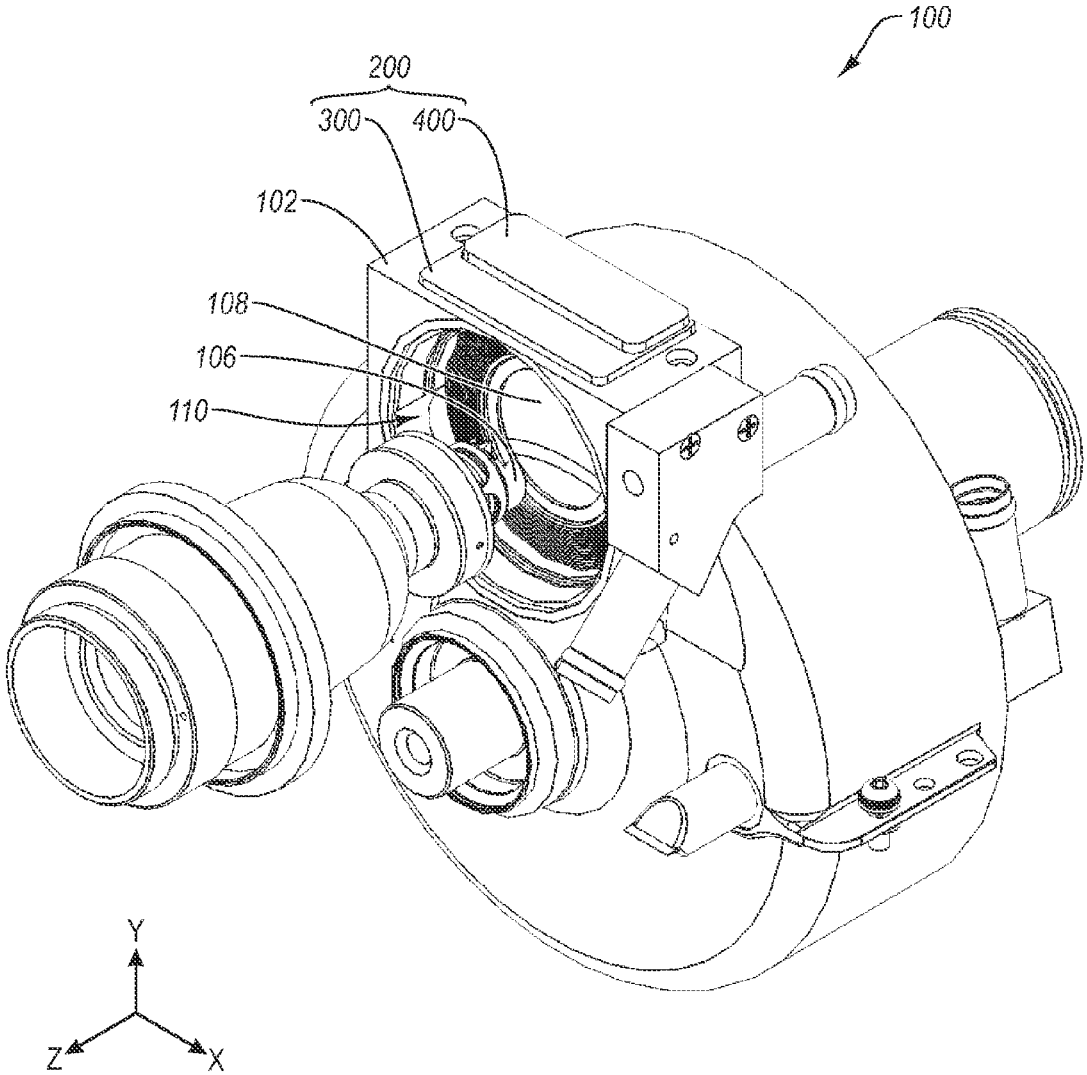
FIG. 1B is a partial perspective view of the example x-ray tube having the example window assembly of FIG. 1.

With reference first to FIGS. 1A and 1B, an example x-ray tube 100 having an example window assembly 200 is disclosed. The example x-ray tube 100 includes, among other things, a housing 102, a can 104, a cathode 106, and a rotating anode 108. The window assembly 200 includes, among other things, a window frame 300 and a window 400. The window frame 300 can be structurally integrated within the housing 102, or can be a separate component that can be attached to the housing 102.

The housing 102, the can 104 (omitted for clarity in FIG. 1B), the window frame 300, and the window 400 cooperate to define at least a portion of a vacuum enclosure 110 that encloses the cathode 106 and the rotating anode 108. Prior to operation of the x-ray tube 100, the vacuum enclosure 110 is evacuated to create a vacuum. During the operation of the x-ray tube 100, electrons emitted from the cathode 106 strike the rotating anode 108. Upon striking the rotating anode 108, a portion of the electrons are converted into x-rays that are directed toward the window 400. As the window 400 is made from an x-ray transmissive material, these x-rays can then escape the housing 102 through the window 400 and strike an intended target (not shown) to produce an x-ray image (not shown). The window 400 therefore seals the vacuum of vacuum enclosure 110 of the x-ray tube 100 from the normal atmospheric pressure found outside the x-ray tube 100, and yet enables x-rays generated by the rotating anode 108 to exit the x-ray tube 100.

Although the example x-ray tube 100 is depicted as a rotary anode x-ray tube, example embodiments of the window assembly 200 can be employed in any type of x-ray tube that utilizes an x-ray transmissive window. Thus, the example window assembly 200 can alternatively be employed, for example, in a stationary anode x-ray tube.

II. First Example Liquid Cooled X-Ray Tube Window Assembly

Figure 2C:
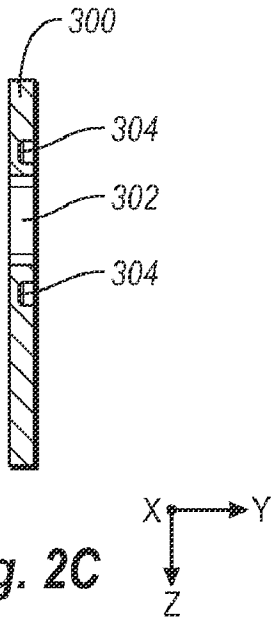
FIG. 2C is a cross-sectional side view of the example window frame of FIG. 2B.
Figure 2B:
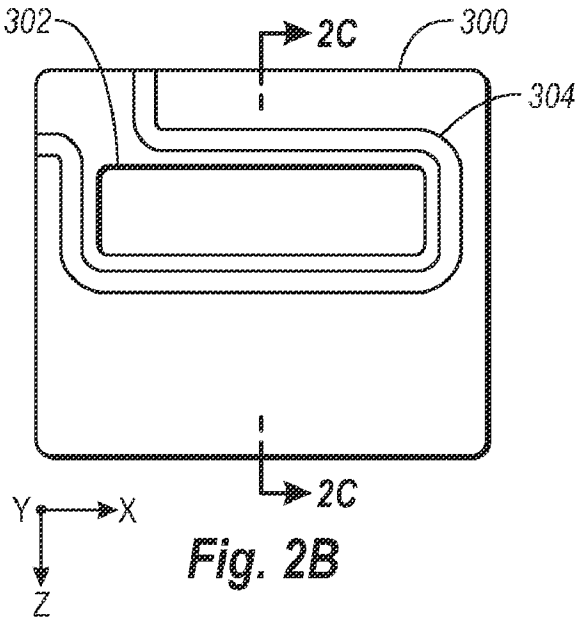
FIG. 2B is a top view of the example window frame of FIG. 2A.
Figure 2A:
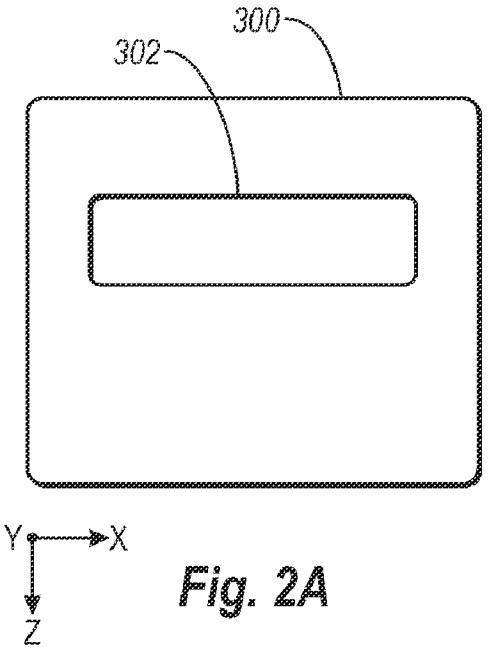
FIG. 2A is a bottom view of a first example window frame of the example window assembly of FIGS. 1A and 1B.

With reference now to FIGS. 2A-2C, additional aspects of the example window frame 300 of the example window assembly 200 are disclosed. FIG. 2A is a bottom view of the example window frame 300. FIG. 2B is a top view of the example window frame 300. FIG. 2C is a cross-sectional side view of the example window frame 300. The perimeter of the window frame 300 is generally rectangularly shaped, although the perimeter could alternatively be various other shapes. In one example embodiment, the example window frame 300 is about 0.205 inches thick, although the example window frame 300 may alternatively be greater than or less than about 0.205 inches thick. The window frame may be formed from various materials including, but not limited to, copper or a copper alloy.

As disclosed in FIGS. 2A-2C, the example window frame 300 defines an opening 302. The opening 302 is generally sized and configured to allow x-rays to pass therethrough. The perimeter of the opening 302 is generally rectangularly shaped, although the perimeter could alternatively be various other shapes. In one example embodiment, the opening 302 is about 2.700 inches long and about 0.740 inches wide, although the example opening 302 may alternatively be greater than or less than about 2.700 inches long and/or about 0.740 inches wide.

As disclosed in FIGS. 2B and 2C, the window frame 300 further defines an example fluid channel 304. The example fluid channel 304 is generally disposed about a portion of the opening 302, although the fluid channel 304 could alternatively be disposed about a greater or lesser portion of the opening 302 than is disclosed in FIG. 2B. For example, the fluid channel 304 could alternatively be disposed all the way around opening 302 so as to completely surround the opening 302. In one example embodiment, the fluid channel 304 is about 0.182 inches wide, although the example fluid channel 304 may alternatively be greater than or less than about 0.182 inches wide. Further, as disclosed elsewhere herein, the geometry, position, size, and orientation of the fluid channel 304 may vary from the configuration disclosed in FIGS. 2B and 2C. The fluid channel 304 may further be accompanied by one or more additional fluid channels, as disclosed elsewhere herein.

Figure 2F:
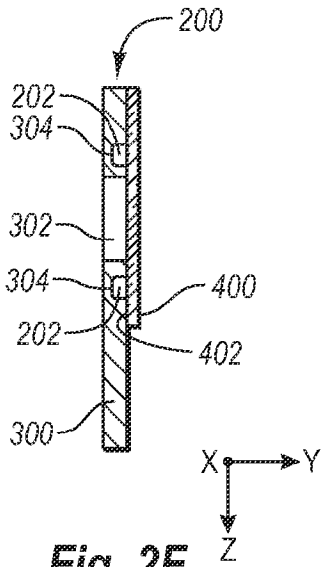
FIG. 2F is a cross-sectional side view of the example window and window frame of FIG. 2E.
Figure 2E:
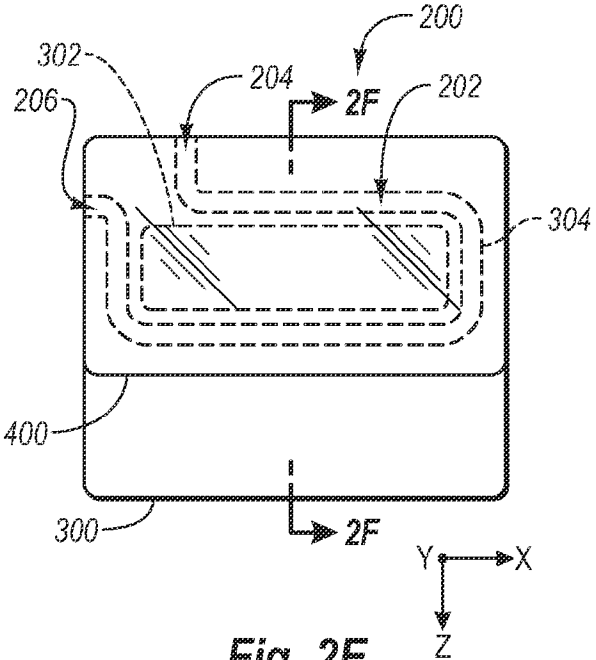
FIG. 2E is a top view of the example window of FIG. 2D attached to the example window frame of FIG. 2A.
Figure 2D:
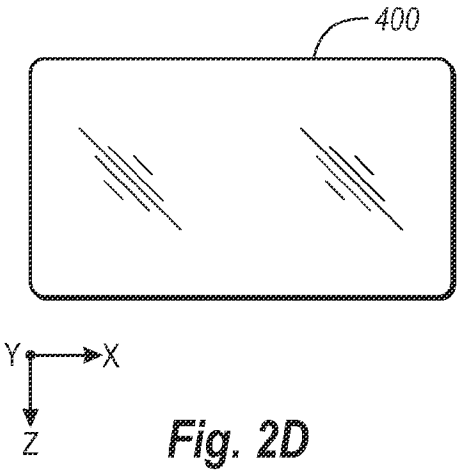
FIG. 2D is a top view of an example window of the of the example window assembly of FIGS. 1A and 1B.

With reference now to FIGS. 2D-2F, additional aspects of the example window 400 and the example window frame 300 of the example window assembly 200 are disclosed. FIG. 2D is a top view of the example window 400. The perimeter of the example window 400 is generally rectangularly shaped, although the perimeter could alternatively be various other shapes. In one example embodiment, the example window 400 is about 0.010 inches thick, although the example window 400 may alternatively be greater than or less than about 0.010 inches thick. The example window 400 can generally be formed from any x-ray transmissive material that is also capable of maintaining a vacuum in the vacuum enclosure of an x-ray tube, such as the vacuum enclosure 110 of the x-ray tube 100 disclosed herein in connection with FIGS. 1A and 1B. In one example embodiment, the window 400 may be formed from at least one of: beryllium, titanium, nickel, carbon, silicon, or aluminum.

FIG. 2E is a top view of the example window 400 attached to the example window frame 300 to form the window assembly 200. FIG. 2F is a cross-sectional side view of the example window assembly 200 of FIG. 2E. The example window 400 can be bonded to the example window frame 300 in a variety of ways, including adhesion, brazing, and/or mechanical fastening. In one example embodiment, at least a portion of a side 402 (see FIG. 2F) of the window 400 that faces the window frame 300 may be coated with a coating of electrically conductive material. This coating of electrically conductive material on the side 402 of the window 400 may improve the bond between the window 400 and the window frame 300. The coating of electrically conductive material may include, but is not limited to: copper, stainless steel, molybdenum, or some combination thereof.

In one example embodiment, the portion of the window frame 300 to which the window 400 is bonded may be recessed slightly such that the window 400 is flush with or recessed from the remaining portion of the top surface of the window frame 300.

As disclosed in FIG. 2E, the window 400 substantially covers the opening 302 defined by the window frame 300. As disclosed in FIGS. 2E and 2F, the window 400 also cooperates with the fluid channel 304 of the window frame 300 to define a fluid passageway 202 disposed about a portion of the opening 302. The fluid passageway 202 is sized and configured to contain cooling fluid. In one example embodiment, a non-dielectric cooling fluid can be employed in the fluid passageway 202. In this example embodiment, a non-dielectric cooling fluid may be employed because the fluid passageway 202 is electrically insulated from other electrically sensitive portions of the x-ray tube 100. Examples of non-dielectric cooling fluid include, but are not limited to: water, propylene glycol, or some combination thereof. In another example embodiment, a dielectric cooling fluid can be employed in the fluid passageway 202. Examples of dielectric cooling fluid include, but are not limited to: fluorocarbon or silicon based oils, or de-ionized water.

In the example embodiment disclosed in FIG. 2E, the fluid passageway 202 includes an inlet 204 and an outlet 206. As disclosed in FIG. 2F, the inlet 204 and the outlet 206 can enable cooling fluid to flow between the fluid passageway 202 and a surface of the window frame 300. In another alternative embodiment, the fluid passageway 202 may include the inlet 204 and the outlet 206, as well as additional inlets and/or outlets. Further, the sizes, locations, and orientations of the inlet 204 and/or the outlet 206 may vary from those disclosed in FIG. 2E. For example, the inlet 204 and/or the outlet 206 may not extend to the edges of the window frame 300 and be defined only by the window frame 300, instead of being defined by the window frame 300 and the window 400. The inlet 204 and/or the outlet 206 may further include additional structure(s) (not shown) that enables the inlet 204 and/or the outlet 206 to be coupled to elements of a cooling system, such as hoses or fluid passageways defined in other x-ray tube structures (not shown).

As disclosed in FIGS. 2E and 2F, the fluid passageway 202 is positioned, sized, and configured such that when cooling fluid is present in the fluid passageway 202, the cooling fluid makes direct contact with the side 402 of the window 400 and with the window frame 300. This direct contact between the cooling fluid with the window 400 and the window frame 300 can thus dissipate heat in the window 400 and the window frame 300 that is generated during x-ray tube operation. The cooling fluid in the example window assembly 200 can thus have a cooling effect on, and thereby reduce thermally-induced deforming stresses on, the window 400, the window frame 300, and the bond between the window 400 and the window frame 300.

Furthermore, by virtue of the fact that the window assembly 200 can be attached to a housing of an x-ray tube, such as the housing 102 of the x-ray tube 100 disclosed in FIGS. 1A and 1B, the window assembly 200 is in thermal communication with the housing 102. This thermal communication of the cooling fluid with the housing, by way of the window assembly 200, can also dissipate heat from the housing of the x-ray tube 100 that is generated during the operation of the x-ray tube 100. The cooling fluid present in the example window assembly 200 can thus have a cooling effect on, and thereby reduce thermally-induced deforming stresses on, the housing to which the example window assembly 200 is attached.

III. Second Example Liquid Cooled X-Ray Tube Window Assembly

Figure 3A:
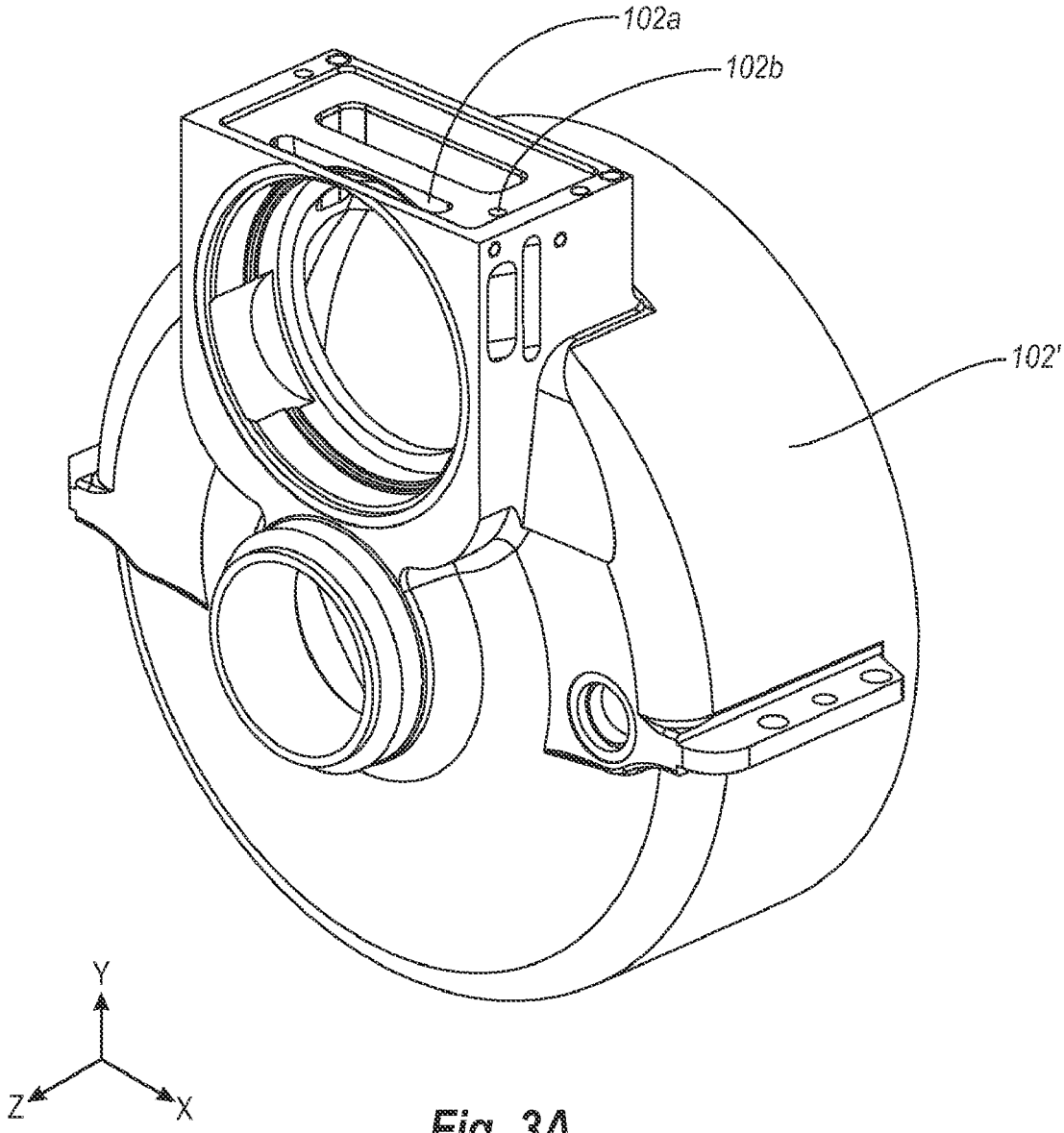
FIG. 3A is a perspective view of an alternate example housing that can be employed in the example x-ray tube of FIGS. 1A and 1B.

With continuing reference to FIGS. 1A and 1B, reference is now made to FIG. 3A which discloses an alternate x-ray tube housing 102' that could be employed in the x-ray tube 100 in FIGS. 1A and 1B in place of the housing 102. One difference between the housing 102' and the housing 102 is that the housing 102' includes inlet 102*a* and outlet 102*b* to which hoses or other cooling system elements (not shown) can be attached in order to circulate cooling fluid through the inlet 102*a* and outlet 102*b*.

Figure 3B:
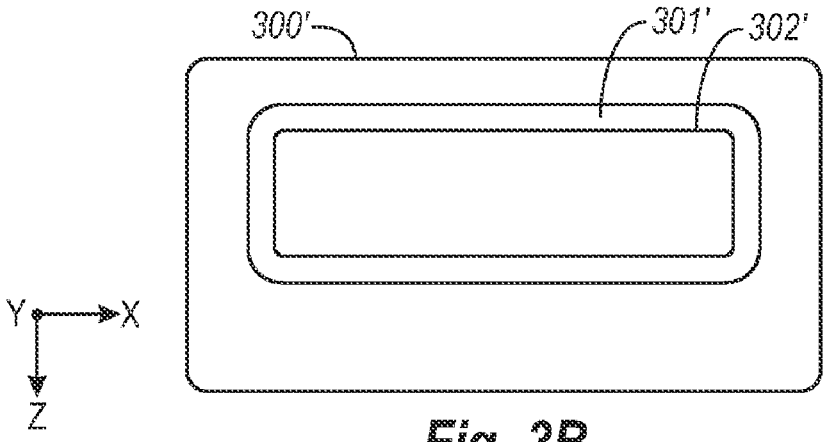
FIG. 3B is a top view of a second example window frame for use with the example housing of FIG. 3A.
Figure 3C:
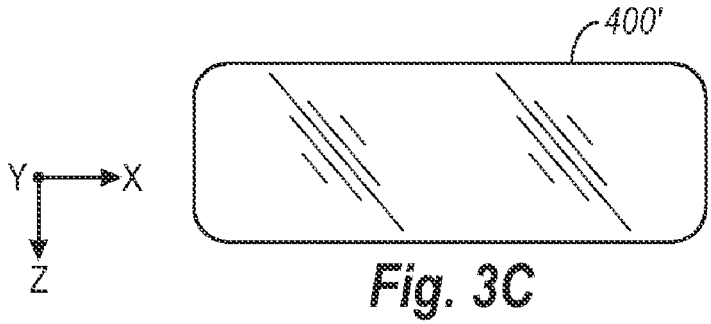
FIG. 3C is a top view of a second example window for use with the example window frame of FIG. 3B.
Figure 3D:
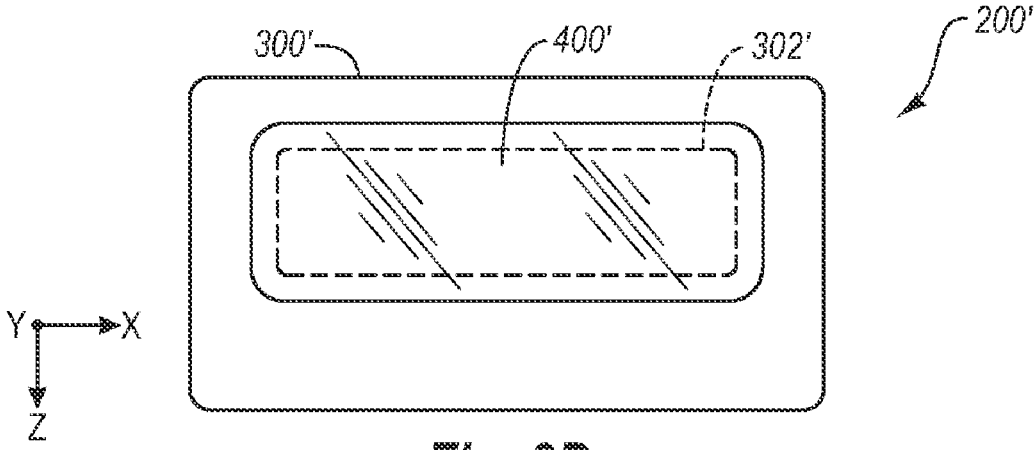
FIG. 3D is a top view of a second example window assembly for use with the example housing of FIG. 3A.
Figure 3E:
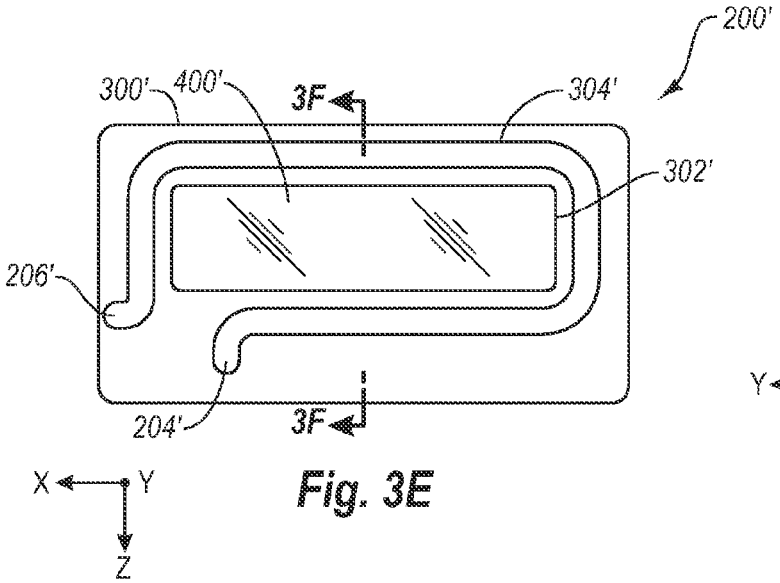
FIG. 3E is a bottom view of the example window assembly of FIG. 3D.
Figure 3F:
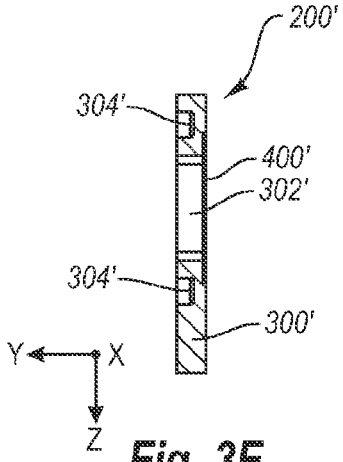
FIG. 3F is a cross-sectional side view of the example window assembly of FIG. 3E.

With reference now to FIGS. 3B-3F, a second example window assembly 200' is disclosed. The example window assembly 200' includes an example window frame 300' and an example window 400', and is similar in many respects to the window assembly 200 disclosed in FIGS. 1A-2F. Therefore, only certain differences between the window assembly 200' and the window assembly 200 will be discussed in detail. FIG. 3B is a top view of the example window frame 300'. FIG. 3C is a top view of a example window 400'. FIG. 3D is a top view of the example window assembly 200'. FIG. 3E is a bottom view of the example window assembly 200'. FIG. 3F is a cross-sectional side view of the example window assembly 200' of FIG. 3E.

As disclosed in FIG. 3B, the example window 400' can have similar perimeter shapes, thicknesses, and/or be formed from similar materials as the example window frame 300 of FIGS. 1A-2C, 2E, and 2F. As disclosed in FIG. 3B, the example window frame 300' defines an opening 302' that can have similar form and function to the opening 302 of FIG. 2A. The example window frame 300' also includes a recessed portion 301' to which the example window 400' can be bonded (see FIG. 3D), as discussed above. As disclosed in FIG. 3C, the example window 400' can have similar perimeter shapes, thicknesses, be formed from similar materials, and/or be coated with similar materials as the example window 400 of FIGS. 1A, 1B, and 2D-2F. As disclosed in FIG. 3D, the example window 400' can also be bonded to the example window frame 300' in a similar manner as the example window 400 is bonded to the example window frame 300. As disclosed in FIG. 3D, the window 400' substantially covers the opening 302 defined by the window frame 300'.

As disclosed in FIGS. 3E and 3F, the example window frame 300' further defines an example fluid channel 304'. The example fluid channel 304' is generally disposed about a portion of the opening 302', although the fluid channel 304' could alternatively be disposed about a greater or lesser portion of the opening 302' than is disclosed in FIG. 3E. For example, the fluid channel 304' could alternatively be disposed all the way around opening 302' so as to completely surround the opening 302'. The example fluid channel 304' can have similar form and function to the fluid channel 304 of FIG. 2B, although it is noted that the example fluid channel 304' does not extend all the way to the sides of the example window frame 300'.

Figure 3G:
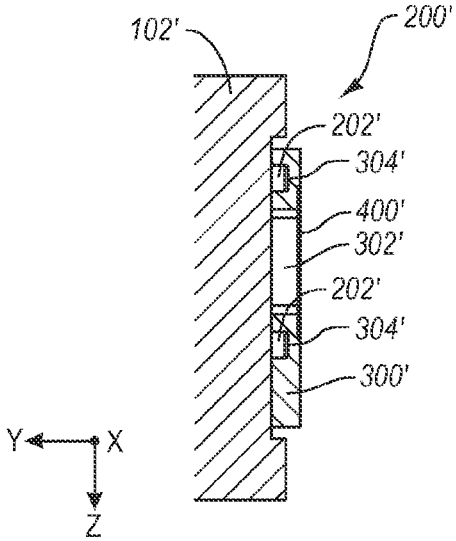
FIG. 3G is a cross-sectional side view of the example window assembly of FIG. 3E attached to the example housing of FIG. 3A.

As disclosed in FIG. 3G, when the example window frame 300' is attached to the housing 102' of FIG. 3A, the housing 102' can cooperate with the window frame 300' to define a fluid passageway 202' disposed about a portion of the opening 302'. The fluid passageway 202' is sized and configured to contain cooling fluid. In one example embodiment, a non-dielectric cooling fluid can be employed in the fluid passageway 202', as disclosed elsewhere herein. In this example embodiment, a non-dielectric cooling fluid may be employed because the fluid passageway 202' is electrically insulated from other electrically sensitive portions of the x-ray tube 100. In another example embodiment, a dielectric cooling fluid can be employed in the fluid passageway 202', as disclosed elsewhere herein.

As disclosed in FIG. 3E, the fluid passageway 202' includes an inlet 204' and an outlet 206' configured and arranged as disclosed in FIG. 3E. When the example window frame 300' is attached to the example housing 102', as disclosed in FIG. 3G, the inlet 204' and the outlet 206' align with the inlet 102*a* and outlet 102*b* defined in the housing 102', respectively. The inlet 204' and the outlet 206' can thus enable cooling fluid to flow between the fluid passageway 202' and the inlet 102*a* and outlet 102*b* defined in the housing 102', and any hoses or other fluid passageways attached to the inlet 102*a* and outlet 102*b*. The sizes, locations, and orientations of the inlet 102*a*, the outlet 102*b*, inlet 204', and/or the outlet 206' may vary from those disclosed in FIGS. 3A and 3E.

As disclosed in FIGS. 3E-3G, the fluid passageway 202' is positioned, sized, and configured such that when cooling fluid is present in the fluid passageway 202', the cooling fluid makes direct contact with the window frame 300', and with the housing 102'. This direct contact of the cooling fluid with the window frame 300' and the housing 102' can thus dissipate heat in the window frame 300' and the housing 102' that is generated during x-ray tube operation. Also, by virtue of the fact that the example window 400' is bonded to the example window frame 300', when cooling fluid is present in the fluid passageway 202', the example window 400' is in thermal communication with the cooling fluid. This thermal communication of the cooling fluid with the window 400' through the window frame 300' can thus dissipate heat in the window 400' generated during x-ray tube operation. The cooling fluid in the window assembly 200' can thus have a cooling effect on, and thereby reduce thermally-induced deforming stresses on, the window frame 300', the housing 102', the bond between the window frame 300' and the housing 102', the window 400', and the bond between the window 400' and the window frame 300'.

In one alternative embodiment, the fluid channel 304' can be formed in the housing 102' of FIG. 3A instead of being formed in the window frame 300' of FIG. 3E. In this alternative embodiment, the housing 102' and the window frame 300' similarly cooperate to define a fluid passageway 202'.

In another alternative embodiment, the fluid channel 304' can be partially formed in the housing 102' of FIG. 3A and partially formed in the window frame 300'. In this alternative embodiment, the housing 102' and the window frame 300' similarly cooperate to define a fluid passageway 202'.

IV. Other Example Liquid Cooled X-Ray Tube Window Assemblies

In one example alternative embodiment, a window assembly may include two or more fluid passageways. Each of the two or more fluid passageways includes an inlet and an outlet. In a first example of this alternative embodiment, a window assembly may define a portion of a fluid passageway between the window and the window frame, and also define a portion of a fluid passageway between the window frame and the housing of the x-ray tube. In a second example, an alternative window assembly may define a portion of two or more fluid passageways between the window and the window frame, and/or may define a portion of two or more fluid passageways between the window frame and the housing of the x-ray tube.

In another example alternative embodiment, the fluid passageways may have a variety of different configurations that are directed to covering more surface area of the window, the window frame, and/or the x-ray tube housing. For example, instead of generally paralleling the perimeter of the opening in the window frame, a fluid passageway may meander along a non-linear shaped passageway, and thereby increase the surface area of the window, the window frame, and/or the x-ray tube housing that can come in direct contact with cooling fluid. Other passageways are also possible and contemplated, such as hub and spoke shaped passageways, railroad track shaped passageways, web shaped passageways, or honey-comb shaped passageways.

The example embodiments disclosed herein may be embodied in other specific forms. The example embodiments disclosed herein are therefore to be considered in all respects only as illustrative and not restrictive.

What is claimed is:

1. An x-ray tube window assembly, comprising:

an x-ray tube window frame that defines an opening; and an x-ray tube window configured to be attached to the x-ray tube window frame such that:

the x-ray tube window substantially covers the opening defined by the x-ray tube window frame; and the x-ray tube window cooperates with the x-ray tube window frame to define a fluid passageway disposed about at least a portion of the opening such that any x-rays that pass through the opening do not also pass through the fluid passageway, the fluid passageway including an inlet and an outlet.

2. The x-ray tube window assembly as recited in claim 1, wherein the x-ray tube window comprises at least one of: beryllium, titanium, nickel, carbon, silicon, or aluminum.

3. The x-ray tube window assembly as recited in claim 2, wherein the x-ray tube window further comprises a coating of electrically conductive material on a surface of the x-ray tube window facing the fluid passageway, wherein the coating comprises at least one of: copper, stainless steel, or molybdenum.

4. The x-ray tube window assembly as recited in claim 1, wherein the x-ray tube window is brazed to the x-ray tube window frame.

5. The x-ray tube window assembly as recited in claim 1, further comprising a non-dielectric cooling fluid disposed in the fluid passageway, wherein the non-dielectric cooling fluid comprises at least one of: water or propylene glycol.

6. An x-ray tube comprising:

a vacuum enclosure;

an anode at least partially positioned within the vacuum enclosure;

a cathode at least partially positioned within the vacuum enclosure; and the x-ray tube window assembly as recited in claim 1 attached to the vacuum enclosure.

7. The x-ray tube window assembly as recited in claim 1, further comprising a dielectric cooling fluid disposed in the fluid passageway, wherein the dielectric cooling fluid comprises at least one of: fluorocarbon-based oil, silicon-based oil, or de-ionized water.

8. The x-ray tube window assembly as recited in claim 1, wherein the x-ray tube window has a substantially uniform thickness.

9. The x-ray tube window assembly as recited in claim 1, wherein the x-ray tube window frame has a substantially uniform thickness.

10. The x-ray tube window assembly as recited in claim 1, wherein the fluid passageway is disposed around substantially all of the periphery of the opening.

11. The x-ray tube window assembly as recited in claim 1, wherein the x-ray tube window frame is substantially non-transmissive to x-rays.

12. An x-ray tube apparatus, comprising:

an x-ray tube window frame that defines an opening, the x-ray tube window frame being substantially non-transmissive to x-rays;

an x-ray tube window attached to the x-ray tube window frame such that the x-ray tube window substantially covers the opening defined by the x-ray tube window frame; and an x-ray tube housing to which the x-ray tube window frame is attached, the x-ray tube housing being substantially non-transmissive to x-rays, the x-ray tube housing cooperating with the x-ray tube window frame to define a fluid passageway disposed about at least a portion of the opening, wherein the fluid passageway includes an inlet and an outlet through which fluid can flow between the fluid passageway and the x-ray tube housing.

13. The x-ray tube apparatus as recited in claim 12, wherein the x-ray tube window frame further defines a fluid channel, wherein the x-ray tube housing cooperates with the fluid channel of the x-ray tube window frame to define the fluid passageway.

14. The x-ray tube apparatus as recited in claim 12, wherein the x-ray tube housing further defines a fluid channel, wherein the fluid channel of the x-ray tube housing cooperates with the x-ray tube window frame to define the fluid passageway.

15. The x-ray tube apparatus as recited in claim 12, wherein the x-ray tube window comprises at least one of: beryllium, titanium, nickel, carbon, silicon, or aluminum and wherein the x-ray tube window has a thickness less than or equal to about 0.010 inches.

16. The x-ray tube apparatus as recited in claim 15, wherein the x-ray tube window further comprises a coating of electrically conductive material on a surface of the x-ray tube window facing the x-ray tube window frame, wherein the coating comprises at least one of: copper, stainless steel, or molybdenum.

17. The x-ray tube apparatus as recited in claim 12, wherein the x-ray tube window is brazed to the x-ray tube window frame.

18. The x-ray tube apparatus as recited in claim 12, further comprising a non-dielectric cooling fluid disposed in the fluid passageway, wherein the non-dielectric cooling fluid comprises at least one of: water, or propylene glycol.

19. An x-ray tube comprising:

the x-ray tube apparatus as recited in claim 12;

a vacuum enclosure comprising at least a portion of the x-ray tube housing;

an anode at least partially positioned within the vacuum enclosure; and a cathode at least partially positioned within the vacuum enclosure.

20. The x-ray tube apparatus as recited in claim 12, further comprising a dielectric cooling fluid disposed in the fluid passageway, wherein the dielectric cooling fluid comprises at least one of: fluorocarbon-based oil, silicon-based oil, or de-ionized water.

21. The x-ray tube apparatus as recited in claim 12, wherein the fluid passageway is disposed about a periphery of at least a portion of the opening such that any x-rays that pass through the opening do not also pass through the fluid passageway.

22. An x-ray tube, comprising:

a vacuum enclosure comprising an x-ray tube housing, the x-ray tube housing defining a first inlet and a first outlet, the x-ray tube housing being substantially non-transmissive to x-rays;

an anode at least partially positioned within the vacuum enclosure;

a cathode at least partially positioned within the vacuum enclosure and an x-ray tube window assembly, comprising:

an x-ray tube window frame that defines an opening, the x-ray tube window frame attached to the x-ray tube housing, the x-ray tube window frame being substantially non-transmissive to x-rays;

an x-ray tube window attached to the x-ray tube window frame such that the x-ray tube window substantially covers the opening defined by the x-ray tube window frame;

wherein the x-ray tube housing cooperates with the x-ray tube window frame to define a fluid passageway disposed about at least a portion of the opening, the fluid passageway including a second inlet positioned proximate the first inlet and a second outlet positioned proximate the first outlet such that fluid can flow between the first inlet and the first outlet through the fluid passageway.

23. The x-ray tube as recited in claim 22, wherein the x-ray tube window frame further defines a fluid channel, wherein the x-ray tube housing cooperates with the fluid channel of the x-ray tube window frame to define the fluid passageway.

24. The x-ray tube as recited in claim 22, wherein the x-ray tube housing further defines a fluid channel, wherein the fluid channel of the x-ray tube housing cooperates with the x-ray tube window frame to define the fluid passageway.

25. The x-ray tube as recited in claim 22, wherein the x-ray tube window comprises at least one of: beryllium, titanium, nickel, carbon, silicon, or aluminum.

26. The x-ray tube as recited in claim 25, wherein the x-ray tube window further comprises a coating of electrically conductive material on a surface of the x-ray tube window facing the x-ray tube window frame, wherein the coating comprises at least one of: copper, stainless steel, or molybdenum.

27. The x-ray tube as recited in claim 22, further comprising a non-dielectric cooling fluid disposed in the fluid passageway, wherein the non-dielectric cooling fluid comprises at least one of: water, or propylene glycol.

28. The x-ray tube as recited in claim 22, further comprising a dielectric cooling fluid disposed in the fluid passageway, wherein the dielectric cooling fluid comprises at least one of: fluorocarbon-based oil, silicon-based oil, or de-ionized water.

29. The x-ray tube as recited in claim 22, wherein the fluid passageway is disposed about a periphery of at least a portion of the opening such that any x-rays that pass through the opening do not also pass through the fluid passageway.

30. An x-ray tube, comprising:

a vacuum enclosure comprising an x-ray tube housing, the x-ray tube housing defining a first inlet and a first outlet;

a cathode at least partially positioned within the vacuum enclosure; and an anode at least partially positioned within the vacuum enclosure and configured to generate x-rays;

an x-ray tube window assembly, comprising:

an x-ray tube window frame that defines an opening through which the x-rays generated by the anode can pass, the x-ray tube window frame attached to the x-ray tube housing; and an x-ray tube window attached to the x-ray tube window frame such that the x-ray tube window substantially covers the opening defined by the x-ray tube window frame;

wherein the x-ray tube housing cooperates with the x-ray tube window frame to define a fluid passageway disposed completely outside a periphery of the opening, the fluid passageway including a second inlet positioned proximate the first inlet and a second outlet positioned proximate the first outlet such that fluid can flow between the first inlet and the first outlet through the fluid passageway.

* * * * *